US009157267B2

(12) United States Patent
Pelekanos

(10) Patent No.: US 9,157,267 B2
(45) Date of Patent: Oct. 13, 2015

(54) ROLLER ASSEMBLY FOR A FOLDING DOOR SYSTEM

(75) Inventor: Stylianos Pelekanos, Regents Park (AU)

(73) Assignee: RMD Industries Pty Ltd, Regents Park, NSW (AU)

( * ) Notice: Subject to any disclaimer, the term of this patent is extended or adjusted under 35 U.S.C. 154(b) by 0 days.

(21) Appl. No.: 14/361,997

(22) PCT Filed: Aug. 14, 2012

(86) PCT No.: PCT/AU2012/000957

§ 371 (c)(1),
(2), (4) Date: Jun. 26, 2014

(87) PCT Pub. No.: WO2013/078496

PCT Pub. Date: Jun. 6, 2013

(65) Prior Publication Data

US 2014/0338264 A1 Nov. 20, 2014

Related U.S. Application Data

(60) Provisional application No. 61/566,344, filed on Dec. 2, 2011.

(30) Foreign Application Priority Data

Dec. 2, 2011 (AU) ..... 2011905037

(51) Int. Cl.
*E06B 3/46* (2006.01)
*E05D 15/26* (2006.01)
(Continued)

(52) U.S. Cl.
CPC ..... *E06B 3/4636* (2013.01); *E05D 13/00* (2013.01); *E05D 15/0621* (2013.01); *E05D 15/26* (2013.01); *E06B 3/481* (2013.01); *E05Y 2201/684* (2013.01); *E05Y 2201/692* (2013.01);
(Continued)

(58) Field of Classification Search
USPC ..... 49/409, 410, 411, 467, 473; 16/87 R, 16/107, 96 R
IPC ..... E06B 3/4636,3/481; E05D 13/00, 15/0621, E05D 15/26
See application file for complete search history.

(56) References Cited

U.S. PATENT DOCUMENTS 1,718,649 A * 6/1929 Jackson, Jr. ..... 160/137
3,523,390 A * 8/1970 McAulay, Jr. ..... 49/411
(Continued)

FOREIGN PATENT DOCUMENTS

CN 2718173 Y 8/2005
DE 29610889 U1 8/1996
FR 2484007 A2 12/1981

OTHER PUBLICATIONS

Written Opinion of the International Preliminary Examining Authority for PCT/AU2012/000957 dated Jul. 11, 2013.
(Continued)

*Primary Examiner* — Gregory Strimbu
(74) *Attorney, Agent, or Firm* — Kilpatrick Townsend & Stockton LLP

(57) ABSTRACT

A roller assembly including a coupling for connecting the assembly to a panel and a roller for transferring the weight load of the panel to a sill, the roller being received in the sill and oriented for rotation about an axis which extends in a direction parallel to the weight load. The roller including a skirt that includes a brush section for sweeping debris off a surface of the sill.

7 Claims, 8 Drawing Sheets

(51) Int. Cl.

| | |
|---|---|
| ***E06B 3/48*** | (2006.01) |
| ***E05D 13/00*** | (2006.01) |
| ***E05D 15/06*** | (2006.01) |

(52) U.S. Cl.

CPC ..... *E05Y 2800/00* (2013.01); *E05Y 2900/132* (2013.01); *Y10T 16/379* (2015.01); *Y10T 16/384* (2015.01); *Y10T 16/3825* (2015.01)

(56) References Cited

U.S. PATENT DOCUMENTS

| | | | | | |
|---|---|---|---|---|---|
| 4,141,106 | A | * | 2/1979 | Dixon | 16/89 |
| 4,388,778 | A | * | 6/1983 | Brooke | 49/125 |
| 4,401,033 | A | * | 8/1983 | Gerken | 104/94 |
| 4,573,286 | A | | 3/1986 | Favrel et al. | |
| 4,837,891 | A | * | 6/1989 | Toma et al. | 16/87.4 R |
| 4,912,807 | A | * | 4/1990 | Futch et al. | 16/90 |
| 5,063,636 | A | * | 11/1991 | Dickson | 16/98 |
| 5,406,676 | A | * | 4/1995 | Williams | 16/87 R |
| 8,683,747 | B2 | * | 4/2014 | Kim | 49/471 |
| 8,844,604 | B2 | * | 9/2014 | Pelekanos et al. | 160/206 |

OTHER PUBLICATIONS

Written Opinion of the International Searching Authority for PCT/AU2012/000957 dated Sep. 28, 2012.

Written Opinion of the International Preliminary Examining Authority for PCT/AU2012/000957 dated Oct. 14, 2013.

International Search Report for PCT/AU2012/000957 dated Sep. 28, 2012.

* cited by examiner

ROLLER ASSEMBLY FOR A FOLDING DOOR SYSTEM

RELATED APPLICATIONS

This application claims priority from Australian Patent Application No. 2011905037 and U.S. Patent Application No. 61/566,344, the contents of which are incorporated by reference.

BACKGROUND

Folding door systems can be either top hung or bottom rolling.

An advantage of a top hung system over a bottom rolling system is hardware used to mount a folding door in an overhead track, at a head of the system, is generally less likely to be subject to dirt and debris contamination. The hardware can accommodate larger rollers so the rolling performance is generally superior. As a result of accommodation of larger rollers, the top hung system can generally hold heavier panels.

A disadvantage of the top hung system is the head requires additional structural support to prevent the system from sagging under the weight. Also, panels of the folding door are more likely to require remedial re-adjustment should the head sag.

With the bottom rolling system, there is no need to provide additional support for the head as the weight load of the door is transferred directly into the floor. There is also no need to provide adjustment as the doors follow the contour of the floor.

However, rollers used in the bottom rolling system are more susceptible to contamination. Generally, the rollers have to be kept relatively small so as to keep the height of the threshold/sill to a minimum. However, smaller rollers tend to have a reduced load bearing capacity, generate more noise and require application of higher opening and closing forces to operate properly.

SUMMARY OF THE INVENTION

In accordance with the invention, there is provided a roller assembly for supporting a panel in a sill, including a coupling for connecting the assembly to the panel and a roller for transferring the weight load of the panel to the sill, the roller being oriented for rotation about an axis which extends in a direction of the weight load.

Preferably, the roller has a lower portion with a chamfered load bearing face which is supported on a rail section of the sill and through which the weight load of the panel is transferred to the sill.

Preferably, the coupling is in the form of a collar which receives a bolt for connection to the panel.

Preferably, the collar and bolt are arranged substantially vertically and the roller is arranged substantially horizontally.

Preferably, the roller has a skirt which is designed clean debris away as the roller rotates.

Preferably, the skirt has a brush section and an elastic band for mounting the skirt onto the roller.

Preferably, the roller has an annular groove separating the roller into an upper and lower portion and band fits into the groove to connect the skirt to the roller.

Preferably, the coupling and the roller are offset so that the connection to the panel is laterally spaced from the axis of the roller.

In another aspect there is provided a sill, including a profile with an access channel, which communicates with an internal void, and a rail section within the void for supporting the roller assembly, as described above.

Preferably, the rail section includes fingers which hold a rail insert.

Preferably, the insert is a polymer strip.

Preferably, the insert has an angled surface, which engages the roller.

Preferably, the sill further includes a sump adjacent the insert, for receiving contaminants from the rail section.

In another aspect, there is provided panel system including a head, a sill and a panel supported in the sill by a roller assembly, as described above.

Preferably, the sill is formed in accordance with the above described sill.

BRIEF DESCRIPTION OF THE DRAWINGS

The invention is described in more detail, by way of example only, with reference to the accompanying drawings, in which.

DETAILED DESCRIPTION

Figure 1:
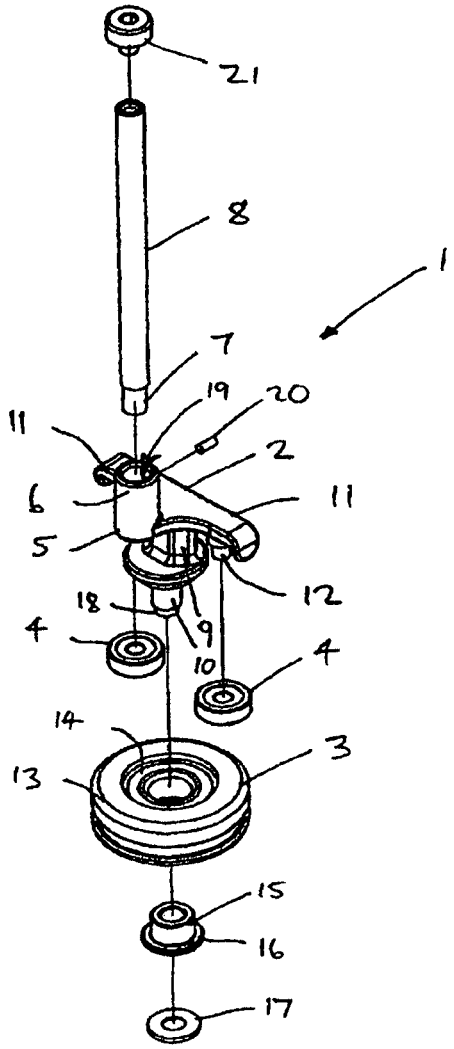
FIG. 1 is an exploded view of a roller assembly.
Figure 2:
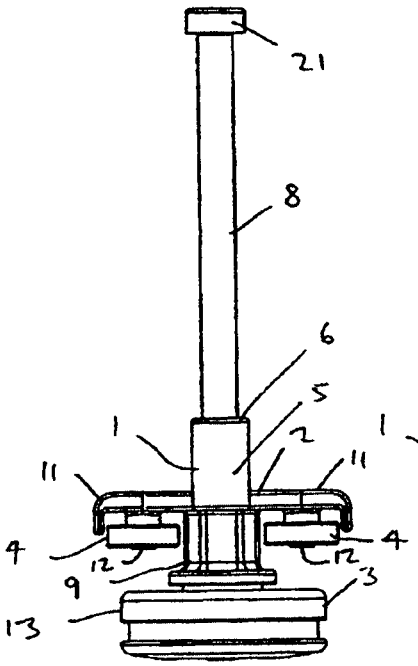
FIG. 2 is a front view of the roller assembly.
Figure 3:
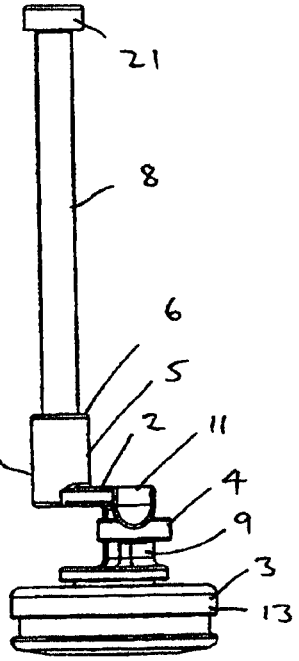
FIG. 3 is a side view of the roller assembly.
Figure 4:
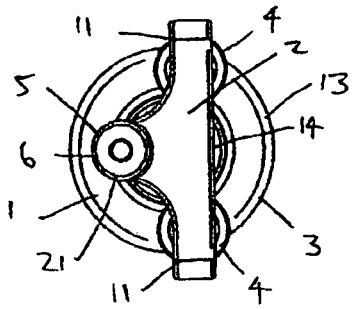
FIG. 4 is a top view of the roller assembly.
Figure 5:
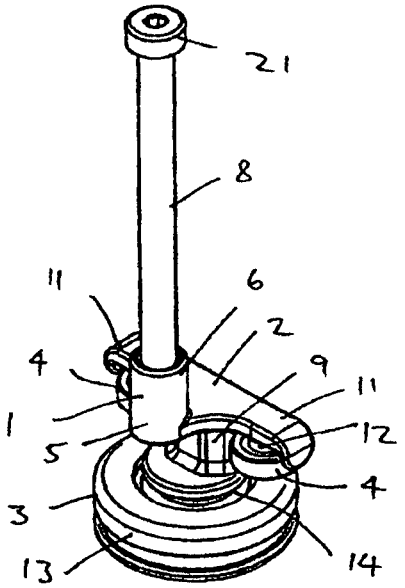
FIG. 5 is a perspective view of the roller assembly.

Referring firstly to FIGS. 1 to 5, a roller assembly 1 is shown as including a body 2, a main roller 3, two thrust rollers 4 and a coupling 5 in the form of a collar 6, which receives an end 7 of a bolt 8.

The body 2 has a base 9, with a downwardly depending axle 10, which carries the roller 3, and two lateral wings 11 which each have a spigot 12 to carry a respective one of the thrust rollers 4.

The roller 3 has an outer rim 13 and an inner bearing race 14. The roller 3 is held captive on the axle 10 by way of a journal 15 which is connected to the axle 10 and which has an annular flange 16 arranged to abut the bearing race 14. A washer 17 is provided to fit over a reduced diameter section 18 of the axle 10 and the section 18 is riveted or swaged over the washer 17 to hold the washer 17 in place to thereby, to secure the journal 15 on the axle 10.

The collar 6 has a though hole 19 and a pin 20, for interconnecting the bolt 8 to the assembly 1. The collar 6 is itself offset relative to the axle 10, however, any weight load applied to the bolt 8 can still be reliably transferred through the body 2 and base 9 to the roller 3: The bolt 8 has a decorative cap 21 which serves to trap the bolt 8 into a hinge of a folding door (not shown).

Figure 6:
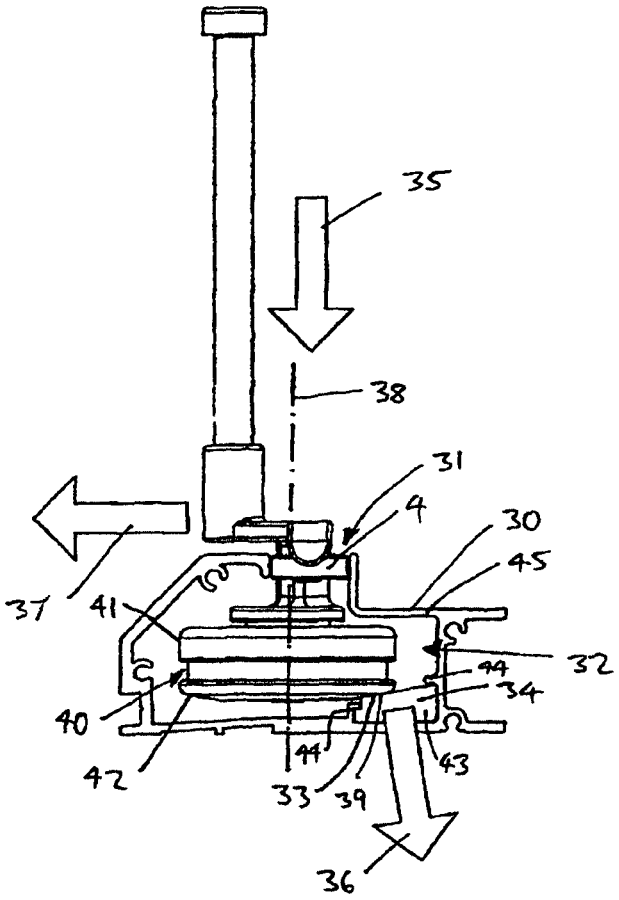
FIG. 6 is a side view of the roller assembly in a sill.

Referring now to FIG. 6, the roller assembly 1 is shown installed in a sill 30. The sill 30 has a channel 31 for the thrust rollers 4. The channel 31 communicates with an internal void 32 that accommodates the main roller 3. The roller 3 is in a horizontal orientation and rests on a load bearing face 33, on a rail section 34 of the sill 30.

Weight load of a panel (such as panel 62 shown in FIG. 11) is diagrammatically illustrated by an arrow 35. The weight load is transferred through the bolt 8, to the roller 3, and subsequently to the sill 30. Any side loading from the bolt 8, such as represented by arrow 37, is transferred to the sill 30 via the thrust rollers 4.

The axis 38 of the roller extends in a direction of the load applied to the roller 3 and, in this case, the roller 3 is substantially horizontal so that the axis 38 is substantially vertical. Since the roller 3 rotates in a horizontal plane and rests only on a small section 39 of the roller 3, the contact with the sill 30 is minimised, to improve rolling performance.

More particularly, the roller 3 is designed with an annular groove 40 between an upper portion 41 and a lower portion 42. The lower portion 42 provides the load bearing face 33 which is bevelled or chamfered to present only the small section 39 to be in contact with the sill 30.

In order to further improve the rolling performance of the roller 3, the rail section 34, on which the roller 3 rests, is provided with a low friction surface formed of, for example, a polymeric material. The sill 30 is generally formed of aluminium for durability so a plastic insert 43 is used. The insert 43 is held in place by retaining ribs 44 formed integrally with the internal wall 45 of the sill 30.

Figure 7:
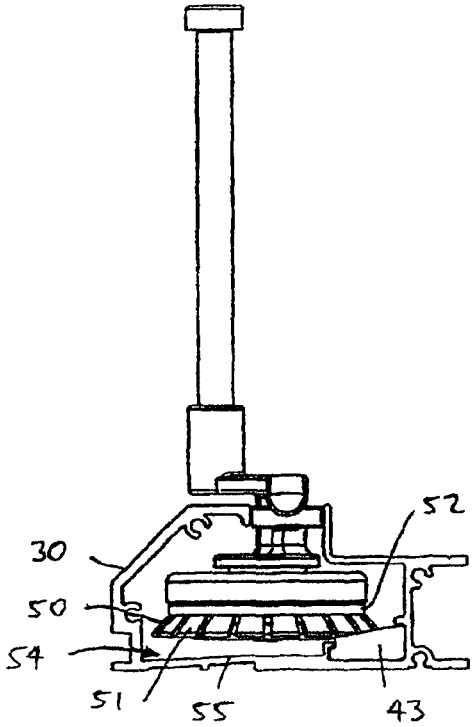
FIG. 7 is a side view similar to FIG. 6, showing a cleaning skirt fitted to the roller assembly.
Figure 8:
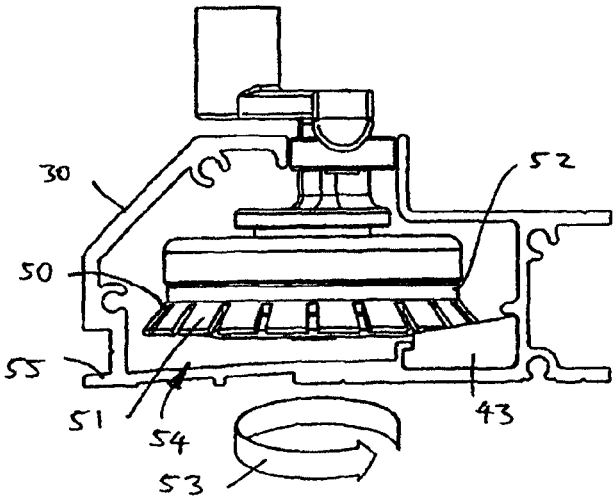
FIG. 8 is an enlarged view of the roller assembly of FIG. 7.

To ensure reliable operation of the roller 3, the surface of the insert 43 needs to be kept clean of contaminants such as dust and dirt that can enter the sill 30 through the channel 31. For that purpose, the roller 3 is provided with a skirt 50, as shown in FIGS. 7 and 8. The skirt 50 has a brush section 51 and an annular band 52 for attaching the skirt 50 to the roller 3. When the roller 3 rotates, as it moves along the sill 30 (as illustrated by an arrow 53 in FIG. 8) the brush section 51 sweeps the surface of the insert 43 clear of contaminants. The contaminants are brushed into a sump 54 provided in a base 55 of the sill 30 and may later be removed by either vacuuming or being flushed out of the sill 30.

Figure 9:
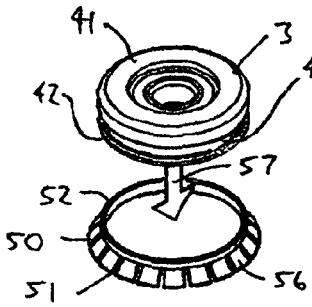
FIG. 9 is a perspective exploded view of a roller and skirt.
Figure 10:
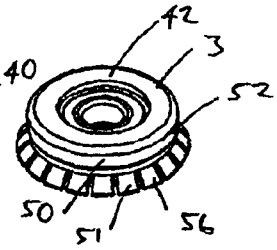
FIG. 10 is a perspective view of the roller with the skirt fitted.

Referring to FIG. 9, the application of the skirt 50 onto the roller 3 is illustrated in more detail. The skirt 50 is preferably formed as a unitary structure, with the brush section 51 comprising a series of tabs or petals 56, which fan out from the annular band 52. The band 52 is elasticised so that the roller 3 can be inserted through the skirt 50 in a direction indicated by an arrow 57. After the skirt 50 is pushed over the lower portion 42 of the roller 3, the band 52 snap fits into the groove 40 formed between the upper and lower portions 41,42, to adopt the configuration shown in FIG. 10.

If the skirt 50 deteriorates after an extended period of use, the band 52 can simply be removed from the roller and a replacement skirt installed, as required.

Figure 11:
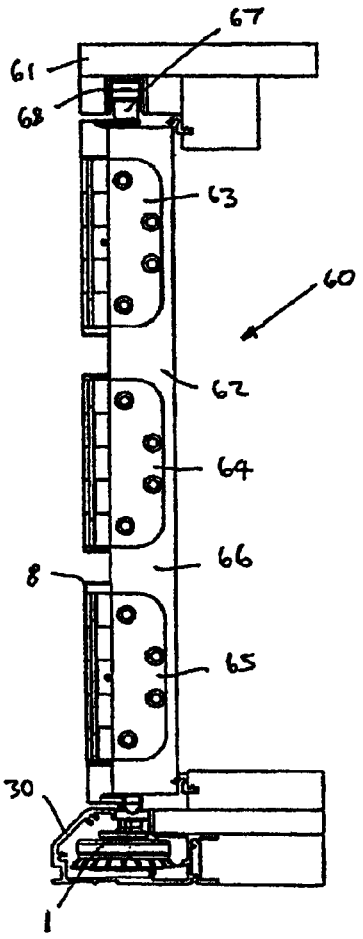
FIG. 11 is a side section view of the roller assembly in a folding door system.

Turning now to FIG. 11, the roller assembly 1 is shown in use in a folding panel system 60. The system 60 includes a head 61, a panel 62 and the roller assembly 1 fitted in a sill 30. Only as single panel 62 is illustrated for ease of description, however, it should be understood the system 60 may include multiple panels, as required, such as in a folding door panel assembly.

The panel 62 is illustrated in a closed configuration with a top hinge 63, intermediate hinge 64 and bottom hinge 65 shown attached to a side edge 66 of the panel 62. The top hinge 63 is connected to a guide roller 67 which runs in an overhead track 68 at the head 61 of the system 60. The lower hinge 65 is connected to the roller assembly 1, via the bolt, which forms a pivot pin for the lower hinge 65.

Figure 12:
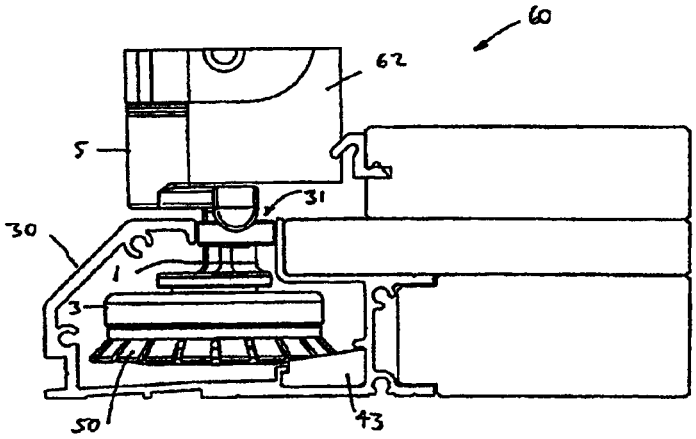
FIG. 12 is an enlarged view of the sill and roller assembly of FIG. 11.

As shown in FIG. 12, the offset of the coupling 5 and the roller 3 allows the roller to be positioned directly beneath the panel 62, which assists in transferring load directly from the panel 62 to the sill 30 but also necessitates the channel 31 to be located underneath the panel 62. In that position, only minimal if any contaminates can enter the channel 31 while the panel 62 is closed. Any contaminants that do enter the sill 30 can, of course, be kept clear of the surface of the insert 43 by the sweeper skirt 50 when the panel 62 is moved between the open and closed positions.

Figure 13A:
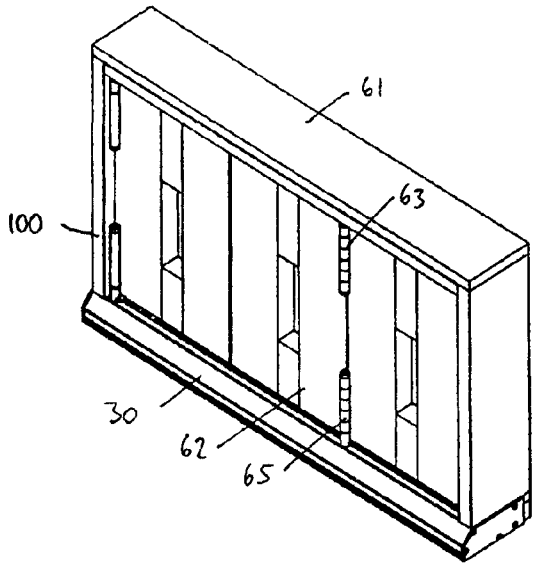
FIG. 13*a* is a perspective view of a folding panel assembly in a closed configuration.
Figure 13B:
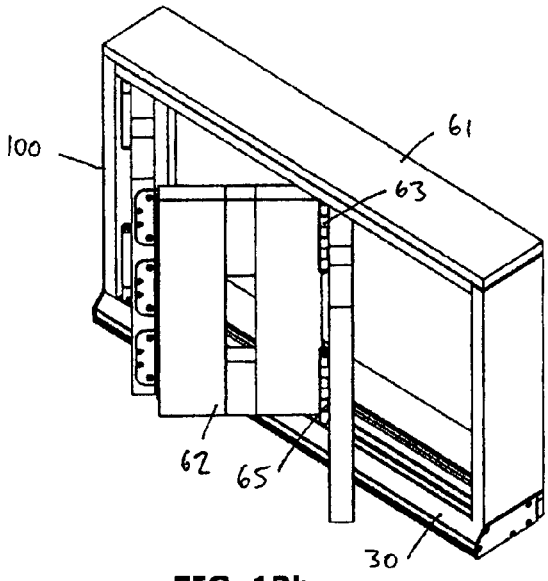
FIG. 13*b* is a perspective view of the folding panel assembly in an open configuration.

The panel 62 described above is a folding panel of a folding panel assembly 100, such as shown in FIG. 13, and is mounted to the head 61 and sill 30 via hinges 63, 65. However, the panel 62 may instead be a sliding panel such as a sliding door, in which case hinges would not be needed and an alternative attachment to the roller assembly 1 would be utilised instead of the bolt 8. Nevertheless, the same horizontal oriented roller 3 could be used to support the sliding door, with a skirt attachment 50 to keep the surface of the insert 43 clear of debris and contaminants.

Figure 14:
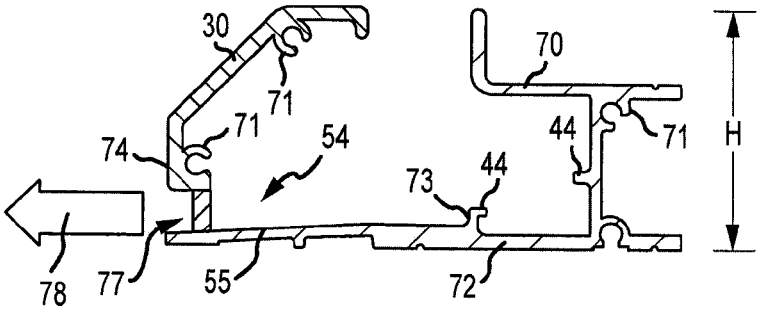
FIG. 14 is a cross-sectional view of the sill.
Figure 15:
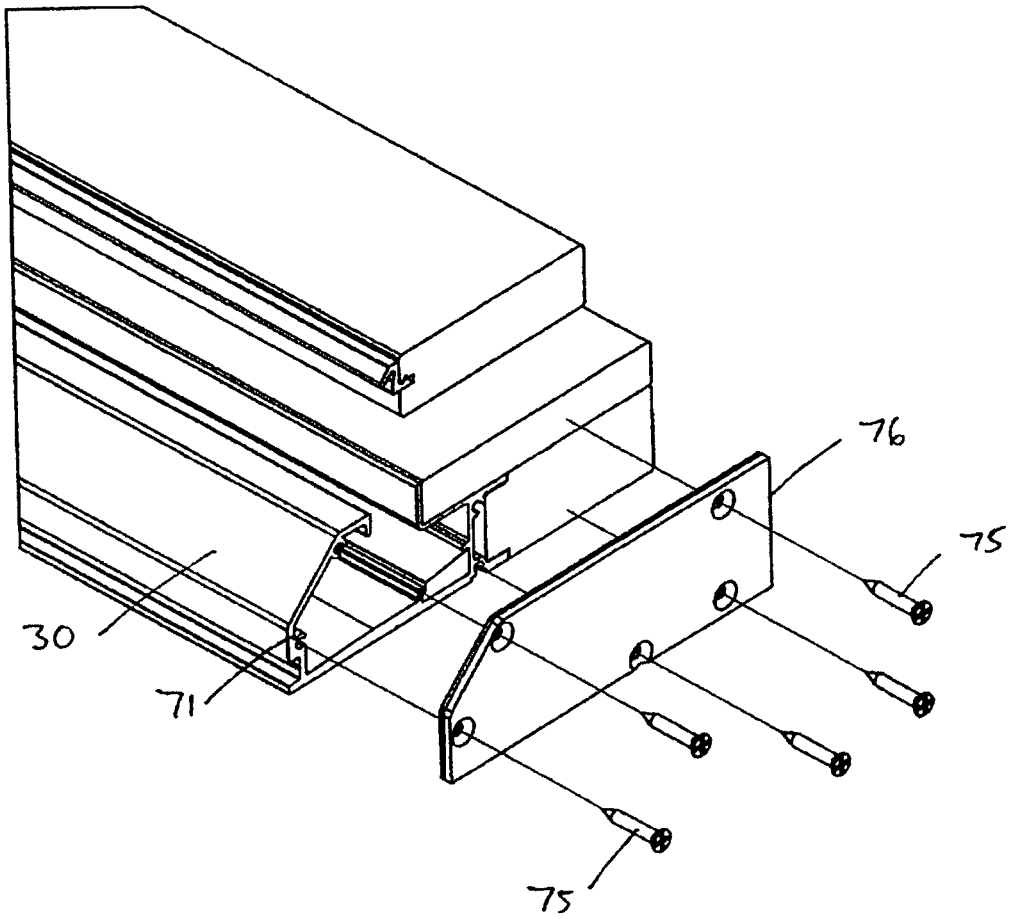
FIG. 15 is a perspective view of the sill and an end cap.

Referring to FIGS. 14 and 15, the sill 30 is preferably formed as an extruded aluminium profile 70, which is designed to have minimum material content whilst maintaining sufficient strength. Various screw flutes 71 are formed in the profile 70 to receive screws 75 for attaching an end cap 76. Since the roller 3 is arranged in the void 32 in a substantially horizontal orientation, the profile also has a relatively low height dimension H, which is a desirable feature for sliding or folding door systems 60.

The retaining ribs 44 which hold the insert 43 in the sill 30 are located toward a rear side 72 of the profile 70, at a slightly elevated position to define one side wall 73 of the sump 54. The base 55 of the sump 54 is angled downwardly, toward a front side 74 of the sill 30 to enhance movement of any contaminates away from the insert 43. Drain holes (one of which is indicated by reference numeral 77) are provided to allow water to be flushed through the sill 30, in a direction indicated by arrow 78, during cleaning.

As may be appreciated, the roller assembly 1 and sill 30 described above provide for favourable contamination and performance outcomes by utilising a very large diameter roller mounted horizontally, although other angles can be used so long as the bearing face 33 of the roller 3 is able to rest on a matching rail section of the sill to allow direct weight load transfer to the sill. The roller 3 may be in the order of 54 mm in diameter, which is considerably larger than conventional bottom rollers.

The larger diameter means the number of revolutions of the horizontal roller is much lower in comparison to traditional smaller wheels and thereby smoother and quieter.

The horizontal roller has only a single point contact with the mating polymer insert 43 integrated into the sill, which further helps reduce noise and wear. The vertical load from the roller 3 is transferred to the insert 43 which is sloped to assist migration of debris off the surface and into the sump 54. Any side loading, perpendicular to the axis 38 of the horizontal roller 3 is accommodated by the thrust rollers 4.

The roller 3 is offset relative to the bolt 8 which, in use, necessitates the channel 31 being positioned under the panel 62, and this provides aesthetic appeal and reduces contamination as any contaminate washed off the panel 62 is directed onto the sill outer surface and washed away. However, in the event contaminates enter the sill, the sump 54 is provided underneath the roller 3 to collect debris which can be removed such as be either heavy rainfall washing the debris through drain holes or vacuumed out through an appropriate access opening.

To provide additional cleaning, the roller may be provided with the skirt 50 which is fitted by being stretched over the circumference of the roller 3, into the dedicated groove 40. The horizontal wheel 3 and sweeper skirt 50 rotate in direct proportion to the panel 62 moving left or right.

The design may incorporate one or more horizontal rollers 3 to increase panel weight capacity. The design may also incorporate one or more horizontal rollers 3 to reduce size or lower operating forces.

The invention has been described by way of non-limiting example only and many modifications and variations may be made thereto without departing from the spirit and scope of the invention.

LIST OF PARTS

1. Roller assembly
2. Body
3. Roller
4. Thrust rollers
5. Coupling
6. Collar
7. End
8. Bolt
9. Base
10. Axle
11. Wings
12. Spigot
13. Rim
14. Bearing race
15. Journal
16. Annular flange
17. Washer
18. Section
19. Hole
20. Pin
21. Cap
30. Sill
31. Channel
32. Void
33. Load bearing face
34. Arrow
36. Arrow
37. Arrow
38. Axis
39. Section
40. Groove
41. Upper portion
42. Lower portion
43. Insert
44. Retaining ribs
45. Internal wall
50. Skirt
51. Brush section
52. Band
53. Arrow
54. Sump
55. Base
56. Petals
57. Arrow
60. System
61. Head
62. Panel
63. Top hinge
64. Intermediate hinge
65. Bottom hinge
66. Side edge
67. Guide roller
68. Track
70. Profile
71. Screw flutes
72. Rear side
73. Side wall
74. Front side
75. Screws
76. End cap
77. Drain hole
78. Arrow
100. Folding panel assembly

The invention claimed is:

1. A roller assembly and sill for supporting a panel, the roller assembly including a coupling for connecting the assembly to the panel and a roller to transfer a weight load of the panel to the sill, wherein:

the sill includes an access channel that communicates with an internal void of the sill, wherein the void houses the roller and the sill further includes a rail section disposed in the void to support the roller and a sump adjacent the rail section; wherein the roller is oriented for rotation about an axis which extends generally parallel to a direction of the weight load;

the rail section includes a surface along which the roller travels and through which the weight load of the panel is transferred to the sill, the surface being angled toward the sump to direct debris off the rail section and into the sump; and the roller is fitted with a skirt that has a brush section that rotates as the roller rotates to sweep the debris off the surface and into the sump as the roller travels along the rail section.

2. The roller assembly and sill of claim 1, wherein the roller assembly further includes thrust rollers that fit in the access channel.

3. The roller assembly of claim 1, wherein the skirt also has a band and the roller has an annular groove separating the roller into an upper portion and a lower portion and the band fits into the groove to connect the skirt to the roller.

4. A sill for a roller assembly having a coupling for connecting the roller assembly to a panel and a roller to transfer a weight load of the panel to the sill, the sill comprising a profile having an internal void, an access channel which communicates with the internal void, and an internal rail section for supporting the weight load of the panel via the roller that travels along the rail section and travels within the void, wherein the sill includes a sump adjacent the rail section and wherein the rail section is an insert that defines a surface angled toward the sump to direct debris and contaminants into the sump, and wherein the insert is fitted between fingers of the profile, with one of the fingers projecting up from a base of the profile in order to define a side wall of the sump.

5. The sill of claim 4, wherein a base of the sump is angled downwardly, toward a front side of the sill to enhance movement of the contaminants and the debris away from the insert.

6. The sill of claim 5, wherein the profile further includes drain holes to allow water to be flushed through the sill.

7. A panel system including a head and the panel, the roller assembly and the sill of claim 1, whereby the panel is supported between the sill and the head.

* * * * *